US008557338B1

(12) United States Patent
Zim et al.

(10) Patent No.: US 8,557,338 B1
(45) Date of Patent: Oct. 15, 2013

(54) CORROSION CONTROL

(71) Applicants: Danilo Zim, Campinas (BR); Matheus P Paschoalino, Campinas (BR); Rafaela F. C. Passos, Campinas (BR)

(72) Inventors: Danilo Zim, Campinas (BR); Matheus P Paschoalino, Campinas (BR); Rafaela F. C. Passos, Campinas (BR)

(73) Assignee: Ecolab USA Inc., Naperville, IL (US)

( * ) Notice: Subject to any disclaimer, the term of this patent is extended or adjusted under 35 U.S.C. 154(b) by 0 days.

(21) Appl. No.: 13/662,660

(22) Filed: Oct. 29, 2012

(51) Int. Cl.
*B05D 7/22* (2006.01)

(52) U.S. Cl.
CPC ..... *B05D 7/22* (2013.01)
USPC ..... 427/230; 427/235

(58) Field of Classification Search
CPC ..... C09D 5/08; B05D 7/22; B05D 7/222
USPC ..... 106/14.05, 14.11, 14.12, 14.13; 427/230–239
See application file for complete search history.

(56) References Cited

U.S. PATENT DOCUMENTS

| | | | | | |
|---|---|---|---|---|---|
| 2,346,151 | A | * | 4/1944 | Burk et al. | 44/500 |
| 2,791,742 | A | | 5/1957 | Karlson | |
| 3,062,684 | A | * | 11/1962 | Treseder et al. | 427/236 |
| 3,347,699 | A | * | 10/1967 | Hitzman | 427/238 |
| 3,837,899 | A | * | 9/1974 | Carlberg | 138/143 |
| 3,999,058 | A | * | 12/1976 | Puyplat | 362/386 |
| 4,000,076 | A | * | 12/1976 | Bodine et al. | 507/113 |
| 4,110,128 | A | * | 8/1978 | Dreulle et al. | 428/628 |
| 4,206,610 | A | * | 6/1980 | Santhanam | 62/50.1 |
| 4,282,006 | A | * | 8/1981 | Funk | 44/280 |
| 4,500,445 | A | * | 2/1985 | French et al. | 252/387 |
| 4,546,612 | A | * | 10/1985 | Santhanam | 62/54.1 |
| 4,624,680 | A | * | 11/1986 | Funk | 44/280 |
| 4,728,546 | A | * | 3/1988 | Rasmussen | 427/409 |
| 4,779,453 | A | | 10/1988 | Hopenfeld | |
| 4,935,195 | A | | 6/1990 | Palusamy et al. | |
| 5,690,704 | A | * | 11/1997 | Hayashi et al. | 44/280 |
| 5,709,731 | A | | 1/1998 | Armstrong | |
| 5,858,443 | A | * | 1/1999 | Hei et al. | 426/506 |
| 6,146,522 | A | * | 11/2000 | Fernholz et al. | 210/143 |
| 6,297,295 | B1 | * | 10/2001 | Gay et al. | 523/130 |
| 6,391,384 | B1 | * | 5/2002 | Deblois et al. | 427/239 |
| 6,586,497 | B2 | * | 7/2003 | Gay et al. | 523/130 |
| 6,620,340 | B2 | * | 9/2003 | Deblois et al. | 252/389.23 |
| 7,398,193 | B2 | | 7/2008 | Araki et al. | |
| 8,168,071 | B2 | * | 5/2012 | Hann | 210/741 |

FOREIGN PATENT DOCUMENTS

| | | | |
|---|---|---|---|
| CA | 959642 | A1 | 12/1974 |
| JP | 8178172 | A | 7/1996 |

OTHER PUBLICATIONS

G. Schmitt, Corrosion Inhibitors in the Mirror of Five Decades; Progress in Corrosion—The First 50 Years of the EFC: (EFC 52), 2009, Maney Publishing.

J. Postlethwaite, The Control of Erosion-Corrosion in Slurry Pipelines; Materials Performance, v. 26, pp. 41-45, 1987.

J. Postlethwaite, Erosion-Corrosion in Slurry Pipelines; Corrosion-NACE, vol. 30 No. 8, pp. 285-290, 1974.

John E. Miller, Slurry Eroision: Uses, Applications, and Test Methods, ASTM Special Technical Publication 946, ASTM Publication Code No. (PCN) 04-946000-29, 1984.

M. Jones, Erosion-corrosion assessment of materials for use in the resources industry, Wear, vol. 267, pp. 2003-2009, 2009.

Erosion-corroision study in fly ash slurry transportation, CEW Chemical Engineering World (1998), vol. 23, (6), pp. 47-48, CODEN:CEWOAY ISSN:0009-2517.

Control of corrosion-erosion in slurry pipelines, Proc. Int. Conf. Intern. External Prot. Pipes, 1st (1975), Paper No. G4, pp. 39-52, Published by BHRA Fluid Eng., Cranfield, England, CODEN:36AKAD.

J. Postlethwaite, Effect of Chromate Inhibitor on the Mechanical and Electrochemical Components of Erosion-Corrosion in Aqueous Slurries of Sand, Corrosion, vol. 37, p. 2, 1981.

* cited by examiner

*Primary Examiner* — William Phillip Fletcher, III
(74) *Attorney, Agent, or Firm* — Benjamin E. Carlsen; Andrew D. Sorensen

(57) ABSTRACT

This invention is directed to a method of inhibiting corrosion-erosion in pipelines carry slurries. The method includes contacting for a period of at least 1 hour an inner surface of the pipeline with a composition of matter, the composition being at least one corrosion inhibitor within a water solvent, purging the pipeline of the water, and then transporting a slurry through the pipeline. This method is surprisingly effective because it prevents erosion with materials that were previously known to not have any effect on erosion. In addition it is effective on especially hard slurries such as bauxite for which previous uses of these inhibitors did not prevent erosion.

14 Claims, 2 Drawing Sheets

CORROSION CONTROL

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates generally to novel methods, apparatuses, and compositions of matter useful in controlling the corrosion of slurry transporting pipelines. As described for example in U.S. Pat. Nos. 8,168,071, 6,586,497, 5,709,731, 4,624,680, 4,546,612, 4,282,006 and 4,206,610, the transport of many slurries (such as ore slurries) is commonly accomplished using mild steel pipelines. Essentially, the ore is grinded and mixed with water in order to form a mud that can then be pumped through the pipeline. These pipelines are therefore subjected to both corrosive and erosive effects. Corrosion is a very well know process by which a chemical reaction takes place on the surface of the metallic material. As a result of this reaction there is a loss of material from the metal surface to the medium in contact which such metal. From practical point of view this phenomenon damages the equipment and reduces its useful lifetime.

Erosion is also a well-known phenomenon by which a mechanical agent physically removes material from a certain surface due to repeated abrasive impacts against the surface. The final consequence also is equipment damage and reduction of useful lifetime.

When slurries are transported through a pipeline, both corrosion and erosion act against the pipeline. Even worse, when both are present each of the two processes enhances the damaging effect of the other, resulting in an even worse synergy between the two. This synergy results in a loss of pipeline material during slurry transport which is larger than the sum of the loss of material caused by erosion and loss of material cause by corrosion. This detrimental effect is commonly referred to as "corrosion-erosion".

The prior art contains a number of strategies for separately addressing corrosion and separately addressing erosion. The prior art however lacks a strategy that directly and efficiently addresses corrosion-erosion when erosion component is aggressive enough to remove the protective layer provided by the corrosion inhibitor and instead relies upon ever greater applications of erosion countering strategies with corrosion countering strategies. Corrosion is commonly addressed by adding to the slurry a corrosion inhibitor whose chemical properties competes with or neutralizes the chemical reactions causing corrosion. Erosion is commonly handled by the careful choice of types and amounts of materials used to make the pipeline components. Often this involves the combination of layered materials and sometimes special coatings over the pipe surfaces.

Prior art combinations of anti-corrosion with anti-erosion strategies, such as those described in U.S. Pat. Nos. 4,935,195, 4,779,453, and 7,398,193 and Japanese Application Patent Laid-Open Publication No. Hei 8-178172 unfortunately suffer from at least two drawbacks. First, they rely upon expensive erosion resistant piping and the constant the need to replace this piping drastically raises the cost of constructing and maintaining pipelines. In addition, it is difficult to impossible to replace many sections of pipelines without imposing major delays and reductions in the operation of slurry transporting activities. In fact, some pipe sections cannot be replaced without completely removing major sections of the pipeline and are therefore cost prohibitive.

Accordingly, there is an ongoing need for a method of reducing corrosion-erosion that does not involve replacing pre-existing sections of pipeline. The art described in this section is not intended to constitute an admission that any patent, publication or other information referred to herein is "Prior Art" with respect to this invention, unless specifically designated as such. In addition, this section should not be construed to mean that a search has been made or that no other pertinent information as defined in 37 CFR §1.56(a) exists.

BRIEF SUMMARY OF THE INVENTION

At least one embodiment of the invention is directed towards a method of inhibiting corrosion in a slurry transporting pipeline. The method comprises the steps of: contacting for a period of at least 1 hour (or even as low as 15 minutes) an inner surface of the pipeline with a composition of matter, the composition being at least one corrosion inhibitor within a water solvent in the absence of any slurry, pumping in an ore slurry into the pipeline, and transporting the slurry through the pipeline. The water may be purged from the pipeline before the slurry is introduced. The corrosion inhibitor may comprise at least 60% water, 1-20% zinc chloride and 1-20% phosphoric acid. The corrosion inhibitor may comprise: zinc compounds including but not limited to zinc phosphates, zinc sulfates, zinc halogenates, etc. and phosphates including but not limited to sodium phosphate, potassium phosphate, ammonium phosphate. The pipeline and the inhibitor may be in contact for between 3 and 24 hours prior to the introduction of the slurry to the pipeline. The slurry may comprise a solid material harder than coal. The efficiency of inhibition may be at least 40%. The inhibitor may be added in a dosage of between 30 (or as low as 5 or 1) ppm and 800 ppm. The pH of the water the inhibitor is within may be adjusted to a pH of between 7.0 and 7.2 and even between 5 and 9. The slurry may comprise bauxite particles.

BRIEF DESCRIPTION OF THE DRAWINGS

A detailed description of the invention is hereafter described with specific reference being made to the drawings in which.

DETAILED DESCRIPTION OF THE INVENTION

Figure 1:
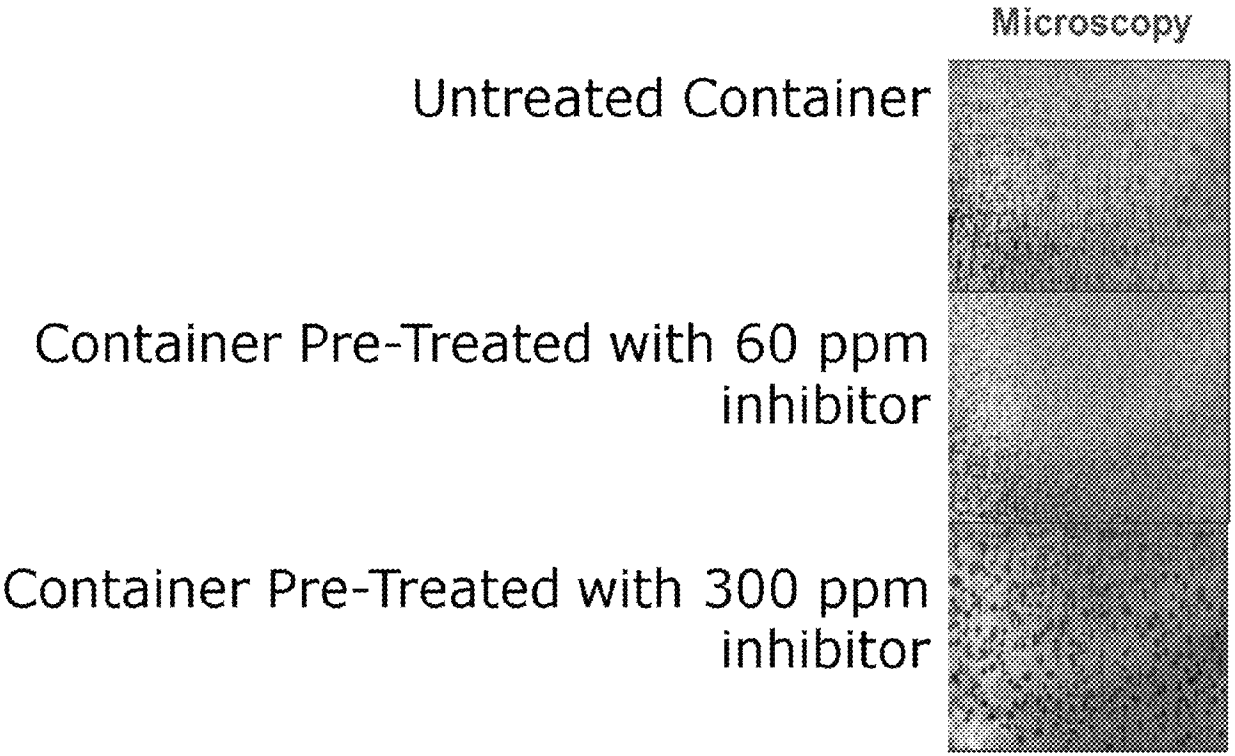
FIG. 1 illustrates microscopy images of (40× magnification) for RCE coupons after 19 hours average of experiment for different dosages of corrosion inhibitor.

The following definitions are provided to determine how terms used in this application, and in particular how the claims, are to be construed. The organization of the definitions is for convenience only and is not intended to limit any of the definitions to any particular category.

"Corrosion" means a chemical process which takes place on the surface of the solid material in contact with a fluidic medium, the process causes a loss of material from the surface to the medium, and it excludes erosion type processes.

"Corrosion-Erosion" means a process in which both corrosion and erosion are occurring simultaneously, often corrosion-erosion results in a synergistic effect resulting in greater mass loss than the sum of the corrosion with the erosion expected for a given medium.

"Corrosion Inhibitor" means a composition of matter known in the art to inhibit the rate of corrosion on a surface in contact with a corrosive fluid.

"Erosion" means a physical abrasive process which takes place on the surface of the solid material in contact with a fluidic medium, the process causes a loss of material from the surface to the medium, and it excludes corrosion type processes.

"Hard" means the measure of how resistant a particular kind of solid matter is to various kinds of permanent shape change when a force is applied, hardness is generally characterized by strong intermolecular bonds, but the behavior of solid materials under force is complex; therefore, there are different measurements of hardness including: scratch hardness, indentation hardness, and rebound hardness.

"Mild Steel" means an iron alloy that contains less than 1.65% of manganese, less than 0.60% of silicon and less than 0.60% of copper, and has a carbon content of between 0.05% and 0.29%, mild steel includes steel alloys with no minimum amount of chromium, cobalt, molybdenum, nickel, niobium, titanium, tungsten, vanadium or zirconium, or any other element. Mild steel undergoes more corrosion under such atmospheric conditions than stainless steel (which has higher nickel and chromium content) does.

"Slurry" means medium comprising a fluidic carrier within which is suspended a number of solid particles, the solid particles include but are not limited to ground rock such as ore, coal ore, bauxite, iron ore, and the like and the fluid is often a liquid such as water, the amount of solid is such that the fluidic carrier has properties associated with a fluid thicker than the carrier alone, slurries include but are not limited to dispersions, solutions, and can have liquid or water carrier fluids.

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims.

At least one embodiment of the invention is directed to a method which minimizes corrosion-erosion in pipelines during ore slurry transport. It has the advantage of allowing for the construction of pipelines with cheaper materials than erosion resistance steels. It also eliminates the need of coating mild steel pipelines built for ore slurry transport and it can be used in existing pipelines as mild steel pipelines. The method comprises the steps of flowing through a pipeline for a period of 3 to 24 hours a fluid containing at least one corrosion inhibitor and then allowing the slurry that may also contain corrosion inhibitor to pass through the pipe. This invention is completely different than the technique described in p. 61 section 2.6 of Corrosion inhibitors in the mirror of five decades by Gunter Schmitt. Schmitt described an especial type of coating which present corrosion inhibitors in its composition. This technique present therefore all already described disadvantages of using coating protection. It just has the advantage over regular coatings of prevent corrosion for some time if the coating is physically damaged.

In at least one embodiment, the degree of effectiveness can be quantified according to the following equation:

$$\text{Efficiency of inhibition}(\%)=((CE-CE_{CI})\times 100)/CE \qquad \text{(equation 1)},$$

where, CE is the corrosion-erosion rate of the ore slurry without any treatment and $CE_{CI}$ is the corrosion erosion rate determined using a specific treatment.

In prior art treatments, corrosion has been addressed by adding corrosion inhibitors into the slurry. This results in the inhibitor reducing the chemical reactions acting against the pipeline. This however does little against erosion because erosion results from the impacts against the pipe surface by ore particles and the corrosion inhibitor in the slurry does not reduce those impacts. Prior art application have shown that corrosion inhibitors result in the lower mass loss as untreated slurries indicating that corrosion inhibitors may provide protection against erosion when present in some slurries. However if erosion component is aggressive enough to remove the protective layer provided by the corrosion inhibitor the protection provided by the use of such corrosion inhibitor will be minimal.

Pre-treating the pipes with the corrosion inhibitor however causes the corrosion inhibitor to also form a protective barrier along the pipe surface that resists erosion to a greater extent than if the inhibitor were present alongside the slurry. This is utterly unexpected as, despite inhibitors are known to form films or barriers along the pipe's surfaces, this films or barriers are extremely thin and are not expected to aid against erosion. In fact as some inhibitors are highly basic or acidic, it would be expected that in the absence of a neutralizing material (such as slurry components) the inhibitor in the absence of slurry could be expected to corrode the pipeline by itself In at least one embodiment the inhibitor is one that would be expected to corrode the pipeline. In at least one embodiment the inhibitor is basic or acidic.

In at least one embodiment the corrosion inhibitor used is at least one of the compositions of matter and the relevant dosages and introduction methods, and/or its effectiveness is assessed according to the methods described in U.S. Pat. No. 2,791,742 and scientific papers: *Corrosion Inhibitors in the Mirror of Five Decades*, by Schmitt, G., Progress in Corrosion—The First 50 Years of the EFC: (EFC 52). Maney Publishing, (2009), *The control of erosion-corrosion in slurry pipelines*, by Postlethwaite, J. Materials Performance, v. 26, p. 41-5, (1987), *Erosion-Corrosion in Slurry Pipelines*, by Postlethwaite, J., Corrosion-NACE, Vol. 30 number 8, pp. 285-290, (1974), *Slurry Erosion: Uses, Applications, and Test Methods*, ASTM Special Technical Publication 946 by John E. Miller, ASTM Publication Code Number (PCN), 04-946000-29, (1984), and *Erosion-corrosion assessment of materials for use in the resources industry*, by M. Jones, Wear Vol. 267 pp. 2003-2009, (2009).

In at least one embodiment the corrosion inhibiter is a composition comprising at least 60% water, 1-20% zinc chloride and 1-20% phosphoric acid.

In at least one embodiment the corrosion inhibiter is a composition comprising at least one of: methoxypropylamine and monoethanolamine. In an embodiment, the corrosion inhibitor of the invention comprises a product of dimethylaminoethoxyethanol, dimethylethanolamine, tall oil, $C_{18}$-unsaturated fatty acid trimers, and branched dodecylbenzenesulfonic acid (DDBSA).

In another embodiment, the corrosion inhibitor of the invention comprises a product of tall oil, reaction products with 2[2-(dimethylamino)ethoxy]ethanol, 2-(dimethylamino)ethanol, $C_{18}$-unsaturated fatty acid trimers, and branched DDBSA.

Representative alkanolamines include N,N-dimethylethanolamines, such as (N,N-dimethylaminoethoxy)ethanol; dimethylethanolamine; triethanolamine; methyldiethanolamine; ethanolamine; diethanolamine; other cyclic amines including morpholine, methylmorpholine, ethylmorpholine, piperidine, alkylpiperidines, piperazine, alkylpiperazines; ethyleneamines including DETA, TETA, TEPA, and the like; alkylamines including methylamine, dimethylamine, alkylmethylamines, dimethylalkylamines; methylaminopropylamine; dimethylaminopropylamine; dimethylaminoethylamine; methylaminoethylamine; the like; and combinations thereof.

Representative fatty acids include trimeric $C_{18}$ unsaturated fatty acid (e.g., CAS 68937-90-6), dimer acids, polymerized tall-oil fatty acids, one or more components of a crude tall oil composition, branched DDBSA, the like, and any combination of the foregoing. For example, a crude tall oil composition may include abietic acid; neoabietic acid; palustric acid; pimaric acid; dehydroabietic acid; palmitic acid; stearic acid; palmitoleic acid; linoleic acid; 5,9,12-octadecatrienoic acid; linolenic acid; 5,11,14-eicosadienoic acid; cis,cis-5,9-octadecadienoic acid; eicosadienoic acid; elaidic acid; cis-1,1-octadecanoic acid, $C_{20}$-$C_{24}$ saturated acids; the like; and any combination of the foregoing.

In an embodiment, the corrosion inhibitor composition of the invention includes the following formula (1) using dimethylalkanolamines with trimer acid [CAS 68937-90-6].

(1)

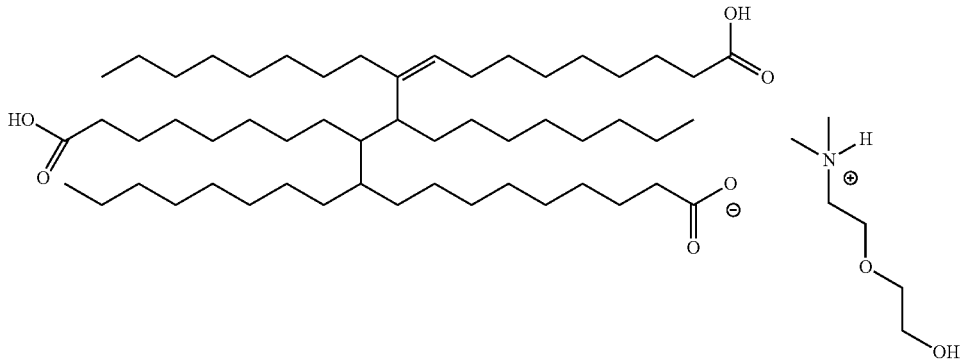

In an embodiment, the corrosion inhibitor composition of the invention includes the following formula (2) dimethylalkanolamines with trimer acid [CAS 68937-90-6].

(2)

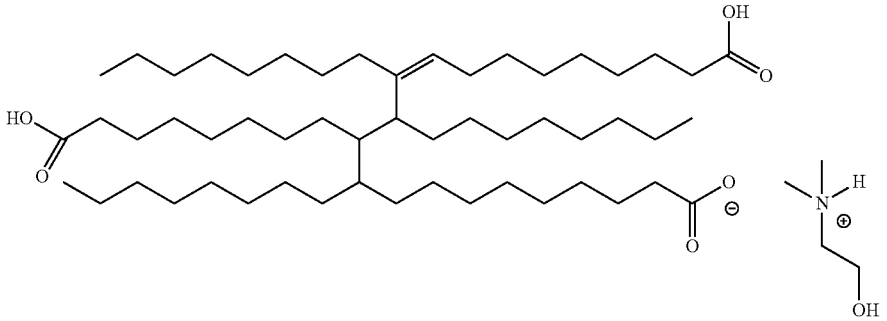

The above formulas (1) and (2), the representative acyclic trimer acid/amine salts which may be formed, for example, in the blending of trimer acid and a mixture of select alkanolamines. For simplicity of weight percentage composition, it has been assumed that the di- and tri-salts formed from two and three equivalents of amine, respectively, versus a single trimer molecule is negligible. Due to the complex mixture of species in trimer acid (i.e., cyclic trimers, aromatic trimers, polycyclic trimers, cyclic dimers, aromatic dimers, polycyclic dimers, and numerous isomeric species of the aforementioned chemicals) a representative acyclic structure of the acid is used. In addition, trimer acid contains variable percentages of dimers and trimers, adding to the complexity. A typical composition can include approximately 40% dimer and 60% trimer with insignificant percentages of the monomer.

In an embodiment, the corrosion inhibitor composition of the invention includes the following formula (3) using dimethylalkanolamines with tall oil [CAS 8002-26-4].

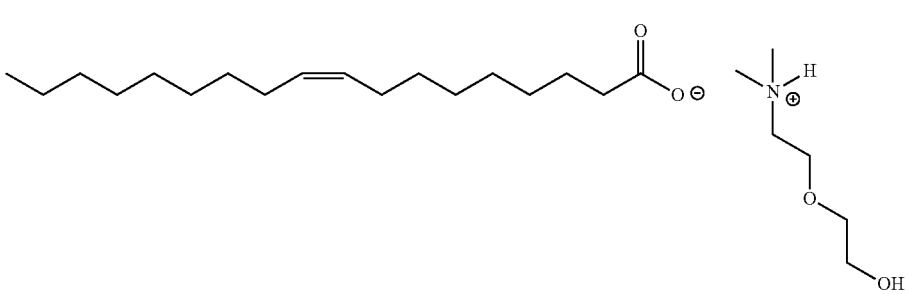

(3)

In an embodiment, the corrosion inhibitor composition of the invention includes the following formula (4) using dimethylalkanolamines with tall oil [CAS 8002-26-4].

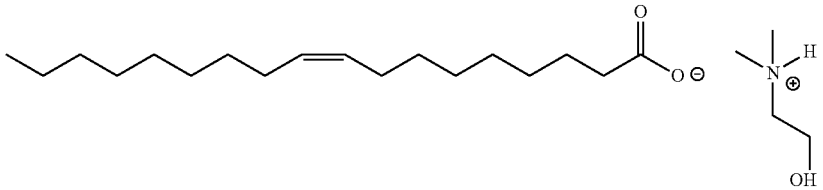

(4)

The second group of salts which can form in this blend is with tall oil, exemplified in formulas (3) and (4) above. Crude tall oil is for example, a by-product of the pulp and paper industry and yields another complex mixture of fatty acids, rosin acids, and lesser amounts of terpenes and sterols. The composition of tall oil is variable with differences seen in regional sources and manufacturing processes as well as seasonal influences. Crude tall oil and distilled tall oil can also be very different. These differences are well known in the art. The structures above provide a representation of the salts formed from dimethylalkanolamines and tall oil (oleic acid is shown).

The structures below provide representative examples of the various acids present in this mixture:

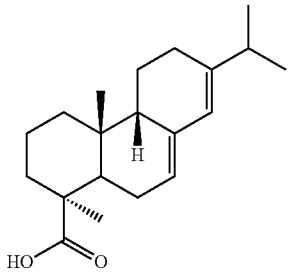

abietic acid

-continued

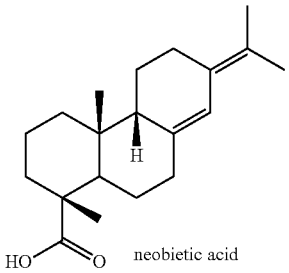

neobietic acid

-continued

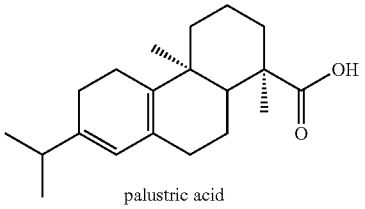

palustric acid

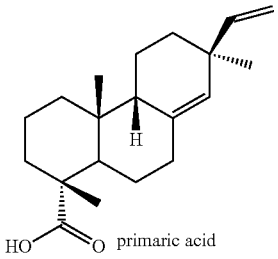

primaric acid

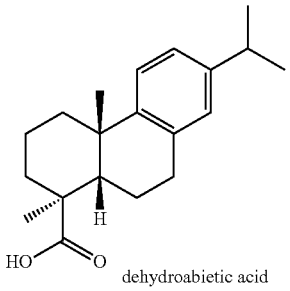

dehydroabietic acid

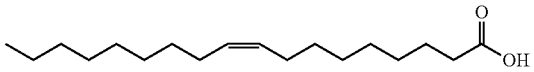

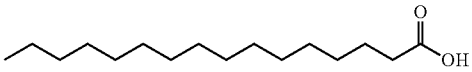

Palmitic acid

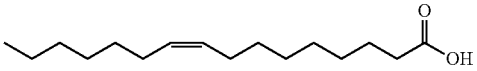

Palmitoleic acid

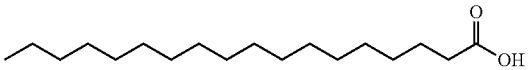

Stearic acid

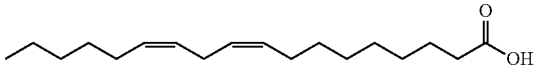

Linoleic acid

Other representative tall oil fatty acids include 5,9,12-octadecatrienoic acid; linolenic acid; 5,11,14-eicosatrenoic acid; cis,cis-5,9-octadecadienoic acid; eicosadienoic acid; elaidic acid; cis-11-octadecanoic acid; and $C_{20}$, $C_{22}$, $C_{24}$ saturated acids. Tall oil fatty acids may comprise any combination of the foregoing examples and others known in the art.

In an embodiment, the corrosion inhibitor composition of the invention includes the following formula (5) using dimethylalkanolamines with branched dodecylbenzene sulfonic acid [CAS 68411-32-5].

(5)

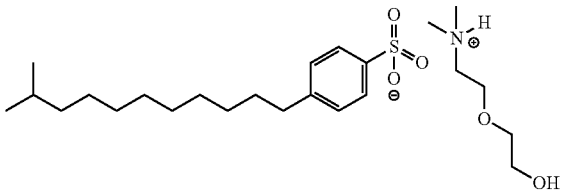

In an embodiment, the corrosion inhibitor composition of the invention includes the following formula (6) using dimethylalkanolamines with branched dodecylbenzene sulfonic acid [CAS 68411-32-5].

(6)

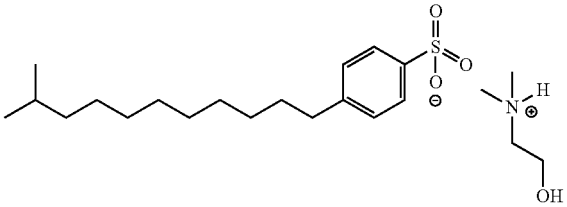

A representative structure of the salts formed with branched dodecylbenzene sulfonic acid (DDBSA) is shown above. The composition of these salts has been approximated based on general reactivity and percentages of each acid added to the blends.

In an embodiment, the product of the invention comprises about 10 wt % to about 100 wt % active ingredient. In another embodiment, the amount of active is from about 10 wt % to about 36 wt %. Preferably, the amount ranges from about 15 wt % to about 30 wt % active. In one embodiment, the product comprises about 27 wt % of the active.

In an embodiment, the corrosion inhibitor composition of the invention may include at least one solvent. Representative solvents include methanol, ethanol, propanol, isopropanol, butanol, isobutanol, aromatic hydrocarbons, isoparaffinic solvents, monoethyleneglycol, ethylene glycol monobutyl ether, the like, water (water can also be used to emulsify the corrosion inhibitor), and combinations thereof. A solvent component aids in corrosion inhibitor delivery and helps provide desirable secondary properties of the product, such as desired viscosity, temperature stability, and the like. In embodiments, the amount of solvent may range from about 8.5 wt % to about 90 wt %. In other embodiments, the amount of solvent may range from about 30 wt % to about 40 wt %.

In an embodiment, the corrosion inhibitor composition of the invention may include at least one dispersant. The dispersant is preferably an oxyalkylate polymer (i.e., polyoxyethylene) such as ethoxylated sorbitan monolaurate. This may include varying oxyalkylated sorbitan esters (e.g., mono, di-, and tri-esters) and non-oxyalkylated sorbitan esters as well. In embodiments, the amount of polyoxyalkylate can vary from about 1-2 mol % up to about 80 mol %, preferably 20 mol %. In embodiments, the amount of oxyalkylated sorbitan esters in the final product ranges from about 1 wt % to about 10 wt %, preferred about 1 wt % to about 5 wt %.

In another embodiment, the corrosion inhibitor composition of the invention further comprises at least one quaternary ammonium compound in the range of about 5-35 wt %, preferred about 5-20 wt %.

In another embodiment, the corrosion inhibitor composition of the invention includes at least one solvent and at least one dispersant.

EXAMPLES

The foregoing may be better understood by reference to the following examples, which are presented for purposes of illustration and are not intended to limit the scope of the invention.

Performance evaluation of a corrosion inhibitor in bauxite slurry was accomplished by using an additive containing ~74% water, ~10.5% zinc chloride and ~15.5% phosphoric acid. The additive was dosed at 60 ppm and 300 ppm in fresh slurry. The mass loss data balance, as well surface visual analysis, was compared with the trial in absence of an anticorrosive. The results are shown in Table 1 and FIG. 1.

TABLE 1

Corrosion rates for bauxite pulp and effect of corrosion inhibitor

| Treatment | Corrosion rate (mm/yr) | Corrosion inhibition (%) |
|---|---|---|
| Untreated | 2.78 | — |
| Additive (60 mg/L) | 2.36 | 15 |
| Additive (300 mg/L) | 2.22 | 20 |

The corrosion inhibitor presented a modest corrosion inhibition, with the best performance achieved at 300 ppm, reaching only 20%. The coupon's surface showed clear signs of localized corrosion even in the presence of the inhibitor. The electrode surface presented similar characteristics observed for river water corrosion, but, in this case, some scratches were also present. This observation suggests that erosion is occurring. Unlike results were reported in scientific references using hexavalent chromium as corrosion inhibitor in coal slurry and silica slurry transport such as: *Slurry Erosion: Uses, Applications, and Test Methods: a Symposium*, by Mille, J. E. Issue 946, ASTM (1987) and Effect of Chromate Inhibitor on the Mechanical and *Electrochemical Components of Erosion-Corrosion in Aqueous Slurries of Sand*, by Postlethwaite, J. Corrosion, v. 37, p. 2, (1981) where good corrosion-erosion protection was achieved. It means that for the present case where bauxite slurry is tested, conventional application of corrosion inhibitor directly into ore slurry did not provided the expected results Since the usual addition of corrosion inhibitor did not completely mitigate mass loss, it was necessary to adopt a different strategy in order to improve performance under bauxite pulp pumping conditions. Taking into account previous data already mentioned and surface characteristics of electrodes at the end of the trials, there is strong evidence that supports the idea that erosion plays a major role in the corrosion process. One possibility for reducing this effect is the adoption of a pre-treatment procedure to prevent both corrosion and erosion.

Figure 2:
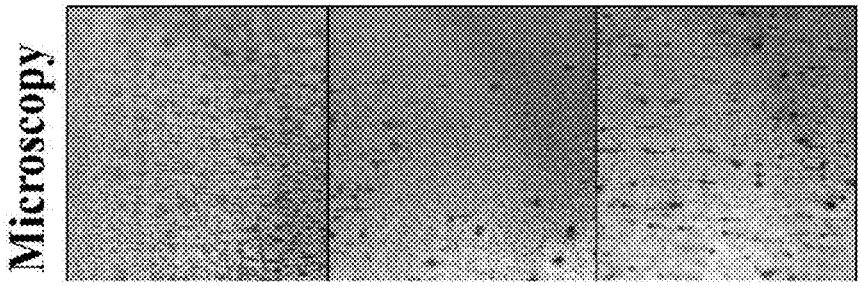
FIG. 2—illustrates a comparison of microscopy (40× magnification) for RCE coupons after 19 hours of experiment using corrosion inhibitor (A) in bauxite slurry.

As shown in FIG. 2, In order to verify this hypothesis, a metallic coupon was pre-treated and then submitted to corrosion trials using bauxite slurry with the additive (60 ppm) after pH adjustment to 7.0-7.2 with $Ca(OH)_2$. The pre-treatment consists on the submersion of the coupon into an aqueous solution of inhibitor (120 ppm) at room temperature for 6 hours. The test results were then compared to the results obtained earlier for untreated slurry, under cathodic protection conditions. Results obtained for untreated slurry cover the effect of chemical corrosion, erosion, and synergy (if any exists). While results obtained under cathodic protection conditions should have eliminated chemical corrosion and, therefore, synergy. Results obtained after pre-treat the electrode are shown in Table 2 and FIG. 2.

Cathodic polarization is a way to prevent corrosion by application of a reducing electric current in a metallic material. It is not practical to use this method to prevent corrosion INSIDE a pipeline because typically current density migrates to the EXTERNAL surface of the pipeline. It is however a useful reference to demonstrate that the invention achieves a very high degree of corrosion protection.

TABLE 2

Corrosion-erosion rates for bauxite pulp and effect of corrosion inhibitor (A) after pre-treatment.

| Treatment | Corrosion-erosion rate (mm/yr) | Corrosion inhibition (%) |
|---|---|---|
| Untreated | 2.78 | — |
| Pre-treatment and Additive (60 mg/L) | 1.42 | 49* |
| Cathodic polarization | 1.05 | 62 |

*Average of two trials, 46% and 52%, respectively.

Results obtained from pre-treat the metal surface before the application of the corrosion inhibitor in the bauxite slurry clearly reduces the total corrosion. The level of corrosion inhibition achieved was 49% (average of two runs 46% and 52%, respectively). Surface analysis corroborates this evidence. The pre-treated surface was less affected than the untreated sample and is comparable with cathodic polarization.

As already mentioned, similar results were reported in literature using hexavalent chromium as corrosion inhibitor in coal slurry and silica slurry transport. However, in these cases, no pre-treatment step was implemented which in our case significantly improved the final results. Corrosion inhibition obtained using inhibitor for mild steel in bauxite slurry under same experimental conditions was improved from 15% to 49% once pre-treatment technique was applied. Besides, since the use of hexavalent chromium was almost completely banished worldwide due its toxicity, it is not a suitable option for use in this application.

These results were particularly surprising in light of the expected results in the prior art. Canadian Patent CA 959642 described a process in which a corrosion inhibitor added to coal slurry helped address both corrosion and erosion. However experimental data has shown that the inhibitors mentioned in that Canadian patent do not inhibit erosion when added to slurries which have harder constituents such as bauxite slurries. This suggests that the relationship between erosion control and inhibitor effect is related to the hardness of the suspended in the slurry. This invention however has been shown to be effective in embodiments where the solid is extremely hard (such as suspended bauxite) and the inhibitor would not be expected to provide any protection against erosion. In at least one embodiment the method involves using the corrosion inhibitor on a slurry containing a solid which is so hard that the corrosion inhibitor provides no protection against erosion when added to the slurry.

ADDITIONAL EMBODIMENTS

The method for inhibiting corrosion of a solid by contacting the solid with an effective amount of the compound or composition in the manner described above may be applied in a number of other uses.

The methods, compounds and compositions of the present invention are useful for corrosion inhibition of containers, processing facilities, or equipment in the food service or food processing industries. The methods, compounds and compositions have particular value for use on food packaging materials and equipment, and especially for cold or hot aseptic packaging. Examples of process facilities in which the compound of the invention can be employed include a milk line dairy, a continuous brewing system, food processing lines such as pumpable food systems and beverage lines, ware wash machines, low temperature ware wash machines, dishware, bottle washers, bottle chillers, warmers, third sink washers, processing equipment such as tanks, vats, lines, pumps and hoses (e.g., dairy processing equipment for processing milk, cheese, ice cream and other dairy products), and transportation vehicles. The methods, compounds and compositions of the invention can be used to inhibit corrosion in tanks, lines, pumps, and other equipment used for the manufacture and storage of soft drink materials, and also used in the bottling or containers for the beverages.

The methods, compounds and compositions can also be used on or in other industrial equipment and in other industrial process streams such as heaters, cooling towers, boilers, retort waters, rinse waters, aseptic packaging wash waters, and the like. The methods, compounds and compositions can be used to treat surfaces in recreational waters such as in pools, spas, recreational flumes and water slides, fountains, and the like.

According to an embodiment of the invention, it is desirable to use the corrosion inhibitor compositions and the claimed methods of use to inhibit the corrosion of metal surfaces contacted with cleaners in surfaces found in janitorial and/or housekeeping applications, food processing equipment and/or plant applications, and in laundry applications. For example, the corrosion of washers, such as tunnel washers for washing textiles, may be inhibited according to methods of the claimed invention.

In addition, surfaces may be contacted according to the methods of the present invention for use in low temperature dish and/or warewash sanitizing final rinse, toilet bowl cleaners, and laundry bleaches. According to further embodiments of the invention, the methods are used to treat metal surfaces, such as ware, cleaned and/or sanitized with corrosive sources.

While this invention may be embodied in many different forms, there described in detail herein specific preferred embodiments of the invention. The present disclosure is an exemplification of the principles of the invention and is not intended to limit the invention to the particular embodiments illustrated. All patents, patent applications, scientific papers, and any other referenced materials mentioned herein are incorporated by reference in their entirety. Furthermore, the invention encompasses any possible combination of some or all of the various embodiments described herein and/or incorporated herein. In addition the invention encompasses any possible combination that also specifically excludes any one or some of the various embodiments described herein and/or incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range. All percentages, ratios and proportions herein are by weight unless otherwise specified.

This completes the description of the preferred and alternate embodiments of the invention. Those skilled in the art may recognize other equivalents to the specific embodiment described herein which equivalents are intended to be encompassed by the claims attached hereto.

What is claimed is:

1. A method of inhibiting corrosion in a slurry transporting pipeline, the method comprising the steps of:

contacting for a period of at least 15 minutes an inner surface of the pipeline with a composition of matter, the composition being at least one corrosion inhibitor within a water solvent in the absence of any slurry, optionally purging the pipeline of the water, and transporting a slurry through the pipeline wherein the corrosion inhibitor comprises at least one zinc compound selected from the list consisting of: zinc phosphates, zinc sulfates, and zinc halogenates, and any combination thereof.

2. The method of claim 1 in which the corrosion inhibitor comprises at least 60% water, 1-20% zinc chloride and 1-20% phosphoric acid.

3. The method of claim 1 in which the pipeline and the inhibitor are in contact for between 3 and 24 hours prior to the introduction of the slurry to the pipeline.

4. The method of claim 1 in which the slurry comprises a solid material harder than coal.

5. The method of claim 1 in which the efficiency of inhibition is at least 40%.

6. The method of claim 1 in which the inhibitor is added in a dosage of between 1 and 800 ppm.

7. The method of claim 1 further comprising the step of adjusting the pH of the water the inhibitor is within to between 5 and 9.

8. The method of claim 1 in which the slurry comprises bauxite particles.

9. The method of claim 1 in which the corrosion inhibitor is so acidic that it would be expected to corrode the pipeline in the absence of an inhibitor.

10. The method of claim 1 in which the inner surface of the pipeline is constructed out of a metal material that comprises mild steel.

11. The method of claim 1 in which the inner surface of the pipeline is constructed out of a metal material that consists essentially of mild steel.

12. A method of inhibiting corrosion in a slurry transporting pipeline, the method comprising the steps of:

contacting for a period of at least 15 minutes an inner surface of the pipeline with a composition of matter, the composition being at least one corrosion inhibitor within a water solvent in the absence of any slurry, optionally purging the pipeline of the water, and transporting a slurry through the pipeline;

wherein the corrosion inhibitor comprises at least one phosphate compound selected from the list consisting of: sodium phosphate, potassium phosphate, ammonium phosphate, and any combination thereof.

13. A method of inhibiting corrosion in a slurry transporting pipeline, the method comprising the steps of:

contacting for a period of at least 15 minutes an inner surface of the pipeline with a composition of matter, the composition being at least one corrosion inhibitor within a water solvent in the absence of any slurry, optionally purging the pipeline of the water, and transporting a slurry through the pipeline;

wherein the slurry comprises a solid material harder than coal.

14. The method of claim 13 in which the slurry comprises bauxite particles.

* * * * *